US007424764B2

(12) United States Patent
Trenz et al.

(10) Patent No.: US 7,424,764 B2
(45) Date of Patent: Sep. 16, 2008

(54) BRUSH WITH LOCKING AND DETACHING STRUCTURE FOR DISPOSABLE HEAD

(75) Inventors: Diethard Trenz, Kiagenfurt (AT); Markus Enzfellner, Ebenthal (AT)

(73) Assignee: Hagleitner Hygiene International GmbH, Zell am See (AT)

( * ) Notice: Subject to any disclaimer, the term of this patent is extended or adjusted under 35 U.S.C. 154(b) by 785 days.

(21) Appl. No.: 10/822,892

(22) Filed: Apr. 12, 2004

(65) Prior Publication Data

US 2004/0187243 A1 Sep. 30, 2004

Related U.S. Application Data

(63) Continuation-in-part of application No. 10/069,993, filed as application No. PCT/AT00/00235 on Aug. 30, 2000, now Pat. No. 6,745,427.

(30) Foreign Application Priority Data

Sep. 1, 1999 (AT) ..... 1507/99

(51) Int. Cl.
*A47K 11/10* (2006.01)

(52) U.S. Cl. ..... 15/210.1; 15/176.1; 15/145; 15/160; 15/209.1; 15/225; 15/226

(58) Field of Classification Search ..... 15/160, 15/159.1, 209.1, 210.1, 211, 143.1, 176.1, 15/176.6, 145, 147.1, 147.2, 223–226
See application file for complete search history.

(56) References Cited

U.S. PATENT DOCUMENTS

| | | | |
|---|---|---|---|
| 1,534,300 | A | 4/1925 | Coltrane |
| 1,572,885 | A | 2/1926 | Corbett |
| 1,636,196 | A | 7/1927 | Robbins |
| 1,665,153 | A | 4/1928 | Withycombe |
| 1,757,853 | A | 5/1930 | Carbone, Jr. |
| 2,443,233 | A | 6/1948 | Filarde |
| D159,243 | S | 7/1950 | Atwood |
| 2,610,347 | A | 9/1952 | Kleiner |

(Continued)

FOREIGN PATENT DOCUMENTS

DE 33 20 586 A1 12/1984

(Continued)

OTHER PUBLICATIONS

International Search Report for International Application PCT/AT03/00268, which claims prioty to the present above-referenced U.S. Appl. No. 10/313,239.

(Continued)

*Primary Examiner*—Gary K Graham
(74) *Attorney, Agent, or Firm*—Laurence A. Greenberg; Werner H. Stemer; Ralph E. Locher

(57) ABSTRACT

A brush, in particular a toilet brush, comprises a brush head holder having a releasable locking means and a detaching means, and a disposable brush head hold on the brush head holder and engaged by the locking means. The locking means and the detaching means are operatively connected so that the detaching means moves the brush head off the brush head holder when the locking means is released.

12 Claims, 2 Drawing Sheets

U.S. PATENT DOCUMENTS

| | | | |
|---|---|---|---|
| 2,666,223 | A | 1/1954 | Farrell |
| 2,666,224 | A | 1/1954 | Adams |
| 2,668,974 | A | 2/1954 | Jaeger |
| 2,755,497 | A | 7/1956 | Greacen, Jr. |
| 2,813,286 | A | 11/1957 | Strader |
| D181,611 | S | 12/1957 | Shumann |
| D181,696 | S | 12/1957 | Williams |
| 3,188,675 | A | 6/1965 | Beck |
| 3,333,290 | A | 8/1967 | Leader |
| 4,031,673 | A | 6/1977 | Hagelberg |
| 4,457,038 | A | 7/1984 | Hammond |
| 4,987,634 | A | 1/1991 | Weihrauch |
| 5,214,820 | A | 6/1993 | Shumway et al. |
| 5,471,697 | A | 12/1995 | Daconta |
| 5,630,243 | A | 5/1997 | Federico et al. |
| 5,875,512 | A | 3/1999 | Lathan |
| 6,094,771 | A | 8/2000 | Egolf et al. |
| 6,158,077 | A | 12/2000 | Wenger et al. |
| 6,182,322 | B1 | 2/2001 | Tubman |
| 6,507,997 | B2 | 1/2003 | Tsuchiya et al. |

FOREIGN PATENT DOCUMENTS

| | | | |
|---|---|---|---|
| DE | 85 210 62.5 | | 1/1988 |
| DE | 92 01 932.3 | | 9/1993 |
| DE | 29709610 | * | 9/1997 |
| DE | 198 32 532 | A | 1/2000 |
| DE | 100 59 764 | A | 6/2002 |
| DE | 202 16 059 | U | 12/2002 |
| FR | 910 236 | A | 5/1946 |
| JP | 8-112219 | | 5/1996 |
| WO | 87/00411 | | 1/1987 |
| WO | 96/37140 | * | 11/1996 |
| WO | 97/45050 | * | 12/1997 |
| WO | 97/49314 | | 12/1997 |
| WO | 97/79315 | | 12/1997 |
| WO | WO 01/15587 | A | 3/2001 |

OTHER PUBLICATIONS

International Search Report for International Application PCT/AT03/00268, which claims priority to the present above-referenced U.S. Appl. No. 10/313,239, Dec. 18, 2003.

* cited by examiner

BRUSH WITH LOCKING AND DETACHING STRUCTURE FOR DISPOSABLE HEAD

CROSS REFERENCE

This application is a continuation-in-part of U.S. application Ser. No. 10/069,993 filed on Mar. 1, 2002 now U.S. Pat. No. 6,745,427 which is a U.S. National Phase Application of International Application No. PCT/AT/00/00235 filed on Aug. 30, 2000 which claims priority of Austrian Application No. A 1507/99, filed on Sep. 1, 1999, which is hereby incorporated by reference.

BACKGROUND OF THE INVENTION

The invention concerns a brush, in particular a toilet brush, with a brush head and a brush head holder, wherein the brush head is detachably mounted to the brush holder.

Traditional brushes, in particular toilet brushes, pose a hygienic problem since the brush head is a good nutritive medium for bacteria and fungi. In addition to the unattractive appearance of the brush after repeated use, this will lead to a health hazard for the user.

A brush of this kind is known from U.S. Pat. No. 2,610,347 A. The brush head is hold on the brush head holder by friction locking and the brush head holder has an ejection mechanism for the brush head. The ejection mechanism comprises a rod which is slidably guided in a tubular member of the brush head holder, and is activated by a pushbutton. Thereby, the rod is pushed into a hole of the brush head and the brush head is ejected. This makes it possible to exchange the entire used brush head for a new sterile one. The used brush head does not need to be touched by hand.

Since the brush head is a single-use article that is disposed afterwards, it is manufactured from paper, cellulose or the like without precision. Therefore, it happens that some brush heads are not sufficiently, but rather loosely hold on the brush head holder and fall off early.

SUMMARY OF THE INVENTION

The invention at hand solves this problem by providing a brush with a brush head holder having a releasable locking means and a detaching means, and with a brush head hold on the brush head holder and engaged by the locking means. The locking means may comprise at least a radially displaceable ball or cog forming a notch or depression into the brush head. The locking means and the detaching means are operatively connected so that the detaching means moves the brush head off the brush head holder when the locking means is released.

Preferably, the brush having a proximal end and a distal end comprises a brush head holder which has a handle near the proximal end, an actuator element movably arranged on the handle, and a motion transfer element disposed between the actuator element and a connection element near the distal end. The connection element movably arranged on the brush head holder is operatively connected both with said locking means and said detaching means.

In a further preferred embodiment the brush head holder is a hollow tubular body carrying the connection element and the locking means in the interior and the detaching means on the exterior. The motion transfer element extends in the interior of the handle from the actuator element to the connection element.

Furthermore, the detaching means may be sleeve-shaped and can serve as a stopper to limit the push-on length of the brush head on the brush head holder.

In a further preferred embodiment the tubular body comprises at least one hole, and the locking means protruding from the hole is withdrawn from the notch or depression formed in the brush head and moved inwardly when released. The locking means is operatively connected to the connecting element via a tapered element slidably arranged in the tubular body and abutting the locking means. The tapered element diverges to the distal end of the brush so that moving of the tapered element to the distal end provides for a space in the interior of the tubular body for receiving the locking element. Therefore, the tapered element in the interior and the detaching means on the exterior of the tubular body can be concurrently moved in the same direction.

In a further preferred embodiment the motion transfer element is a flexible wire so that it can be used with a bent handle as well. The bending of the handle facilitates cleaning of hard-to-reach areas of toilet bowls and the like.

A brush head to be utilised in the invention contains, for the purpose at hand, bristles made of degradable material, in particular paper. The bristles can be arranged on a mounting element, in particular a receiving sleeve made of degradable material, especially paper. This makes it possible in the case of toilet brushes to dispose of the brush head via the toilet without coming into direct contact with it. A preferred model of the brush head is characterised by the fact that the receiving sleeve is designed as a hollow cylinder in order to be stuck onto a cylindrical end section of the brush head holder.

A protective sleeve surrounding the bristles can be provided in order to keep the bristles together prior to their first-time use.

To achieve better cleaning, disinfection, and hygienic odours, the brush head may be impregnated with a cleaning and/or disinfection and/or scent agent, preferably in gel form.

Now, the invention will be described in detail, using non-restricting sample models and making reference to the drawings. In the drawings, parts that are identical or identical in function are indicated by the same reference symbols.

DESCRIPTION OF PREFERRED EMBODIMENTS

Figure 1:
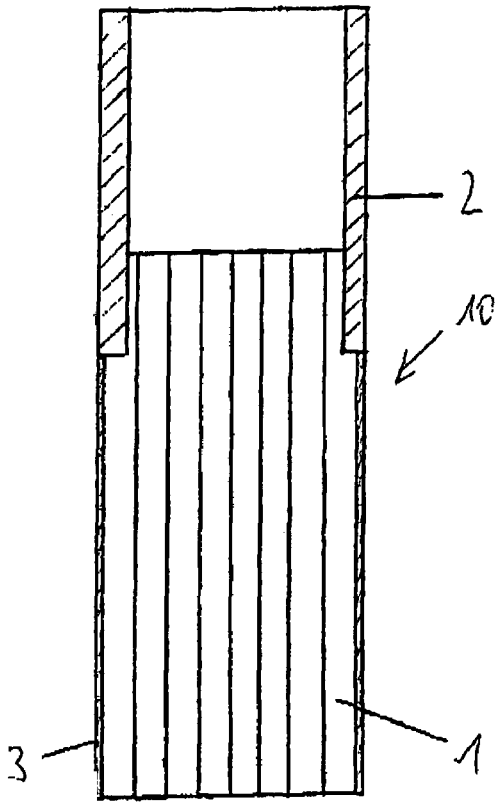
FIG. 1 shows a brush head according to the invention schematically in a longitudinal section.
Figure 2:
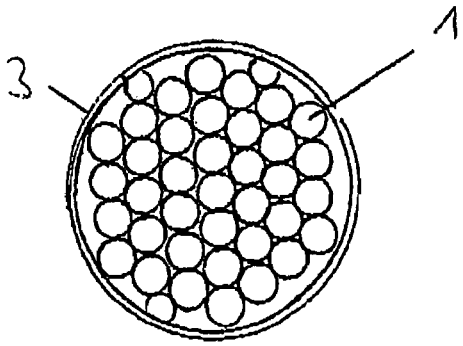
FIG. 2 shows the brush head in a horizontal projection.
Figure 3:
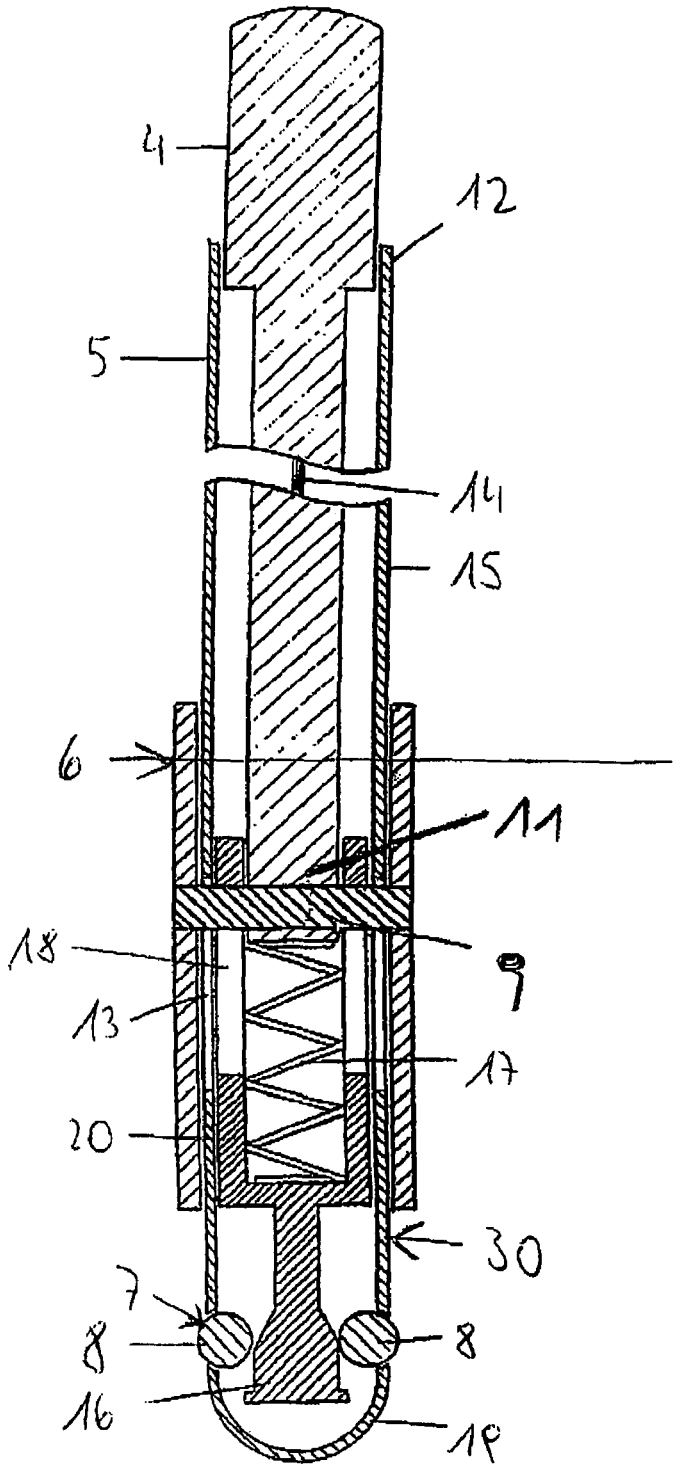
FIG. 3 shows a first embodiment of a brush head holder of the invention in a longitudinal section.
Figure 4:
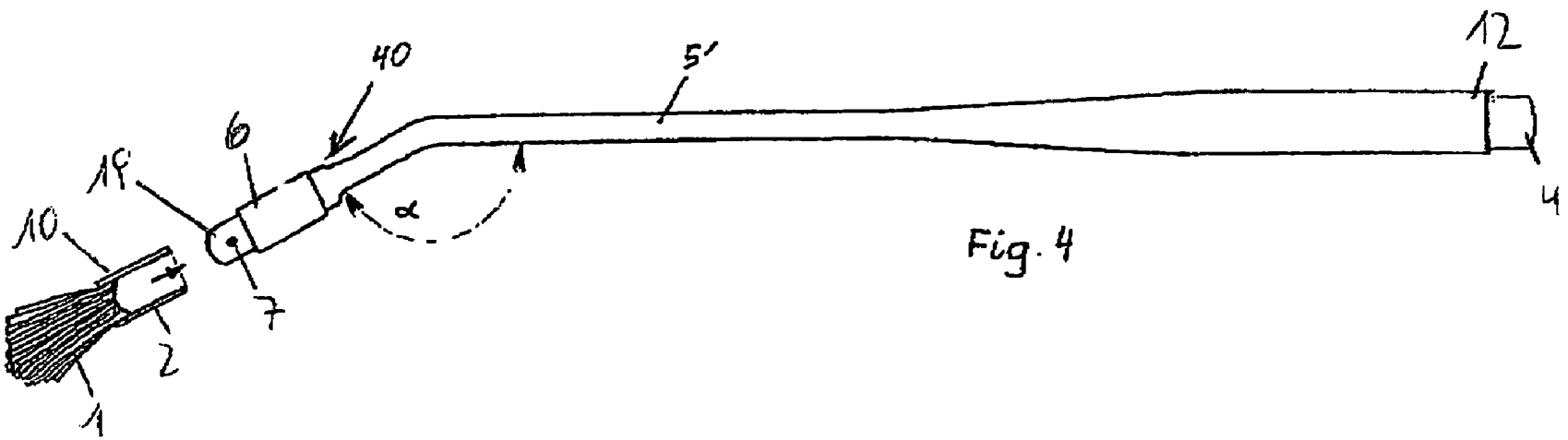
FIG. 4 shows a second embodiment of a brush head holder according to the invention in a side view.

The brush according to the invention, shown as a toilet brush, consists of a brush head 10, as shown in FIGS. 1 and 2, and a brush head holder as indicated in FIG. 3 or 4 in general by the number 30, 40. The brush head 10 is executed as a one-way brush head and consists of a sleeve 2 that precisely fits the brush head holder 30. If necessary, the sleeve 2 can be supplemented by an extension tube made of cellulose or the like in order to be able to effectively clean hard-to-reach places in toilet bowls, etc. Connected to the sleeve 2 are several rolled-up paper strips or similar that serve as bristles 1 and that are held together by a protective cover 3. Prior to using the one-way brush, the protective cover 3 must be removed, allowing the bristles 1 of the brush head 10 to unfold. After use, the brush head 10 can be thrown off by means of an actuator element 4 on the proximal end 12 of the brush head holder 30 and into the toilet bowl, and then disposed of. The brush heads of the invention consist of a well-degradable material, in particular a material that is easily soluble in water, e.g. one similar to toilet paper. Preferably, the brush heads are made of cellulose or a water-soluble plastic that can be made from replenishable raw materials. Such water-soluble plastic can be processed like normal plastic in jet mouldings, but it has the advantage that the brush heads made of this material can also be disposed off via the toilet due to its water solubility. Such materials are soft enough to be notched or depressed by a radially outwardly forced locking means 7. Furthermore, the brush head can be impregnated with scent, cleaning and/or disinfection agents, with these agents preferably being used in gel form.

FIG. 3 shows in detail that the brush head holder 30 is equipped with a locking means 7 that firmly locks the brush head 10 in position after it has been stuck on and assures a good hold of the brush head 10 on the brush head holder 30. The brush head holder 30 comprises a tubular body 15 made of metal, PVC or similar, onto which the sleeve 2 of the brush head 10 can be stuck. The tubular body 15 is equipped with a sleeve-shaped detaching means 6 that makes it possible to detach or slide off the brush head 10 by means of the actuator element 4.

The tubular body 15 is further equipped with a connection element 11 slidable in the tubular body 15. A motion transfer element 14, e.g. a rod-shaped extension 11 of the actuator element 4 or a wire, is arranged in the interior of the brush head holder 30 between the actuator element 4 on the proximal end 12 and the connection element 11. Pushing the actuator element 4 moves the connection element 11 towards the distal end 19. The tubular body 15 comprises and at least one hole through which the locking means 7 protrudes. The tubular body 15 further comprises two oblong slots 13. A bolt 9 extends through the oblong slots 13 and connects the connection element 11 in the interior with the sleeve-shaped detaching means 6 on the exterior of the tubular body 15.

In the tubular body 15 a member 20 carrying a tapered element 16 which diverges to the distal end 19 is slidably arranged on the connection element 11. The member 20 also has oblong slots in accordance with the oblong slots 13 of the tubular body 15, and a spring 17 is arranged between the distal end of the connection element 11 and the tapered element 16. The spring 17 has an expanded position as shown in FIG. 3 from which the tapered element 16 is retracted and the balls 8 or cogs of the locking means 7 are forced outwardly by the taper of element 16, thereby forming depressions into the sleeve 2 of a mounted brush head 10.

When the brush head is to detach, the actuator element 4 is pressed and the connection element 11 is moved forwardly. The spring 17 firstly will be retracted into a neutral position and then compressed so that the tapered element moves to the distal end 19. The locking element 7 is released, because its balls 8 can enter the hollow space in the interior of the tubular body 15 and disengage from the previously formed notches or depressions in the sleeve 2 of the brush head 10.

At this time, the sleeve-shaped detaching means 6 moving with the connection element 11 via the bolt 9 touches the disengaged sleeve of the brush head 10 and moves it actively off the brush head holder 30.

Figure 5:
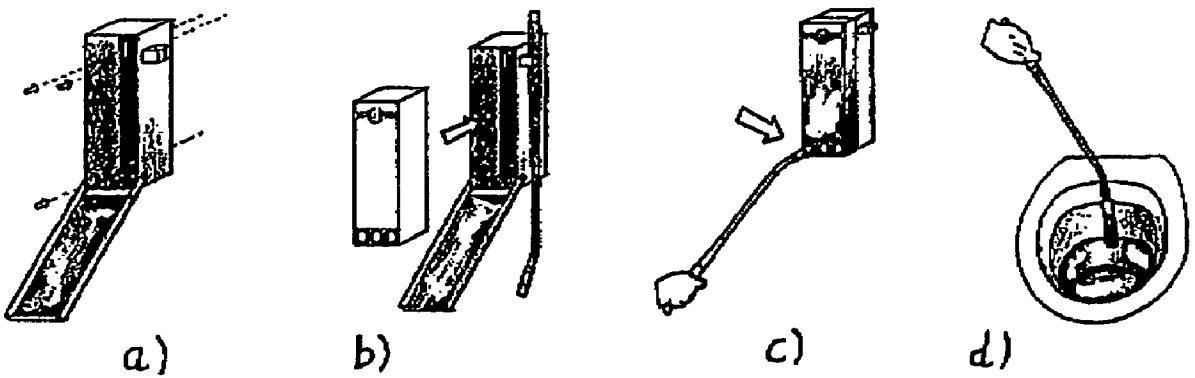
FIG. 5 shows the utilisation of a brush head holder together with a brush head dispenser.

Going now to FIG. 5, a one-way brush head dispenser consists, e.g. of a storage container with several brush heads that drops in front of a removal opening by force of gravity or a spring. Several small knives may be arranged around the removal opening that tear open the protective cover of the brush head when it is pulled out of the removal opening. The brush head holder is stuck through the removal opening into the brush head and automatically locked in place by means of the ball mechanism. When the one-way brush is pulled out, the protective cover of the brush head is torn open and the one-way toilet brush is instantly ready to use. The process is shown in FIG. 5 in the sequence a) through d). In step a), a magazine for the storage container is first mounted on the wall with screws or, alternatively, with adhesive tape. The magazine has a front wall that can be folded out and whose lower end has an opening for the insertion of the brush head holder. In step b), the storage container is placed into the magazine, and it can be seen that the brush sits in a holder on the right side of the magazine. In step c), the brush head holder is stuck into a brush head, and the brush is thus ready to use. In step d), the cleaning process can now be carried out.

FIG. 4 shows another embodiment of a brush head holder 40 according to the invention in a side view. It differs from the embodiment described above in that the handle 5' is equipped with a bend $\alpha$ of approximately 155° near the distal end. This makes it possible to clean hard-to-reach places in toilet bowls as well. The brush head holder 40 features a flexible motion transfer element, e.g. a wire, extending in the interior of the handle 5' between the actuator element 4, e.g. a pushbutton and the connection element 11 in the tubular body 15.

The invention claimed is:

1. A brush, comprising:

a brush head holder having a hollow tubular body, a releasable locking means in an interior of said tubular body, and a detaching means on an exterior, said tubular body having oblong slots;

a connection element movably disposed on said brush head holder and carrying a bolt sliding in said oblong slots, said bolt being operatively connected with said releasable locking means and with said detaching means; and a disposable brush head held on said brush head holder and engaged by said locking means, wherein said detaching means moves said brush head off said brush head holder when said locking means is released.

2. The brush according to claim 1, wherein said detaching means is sleeve-shaped.

3. The brush according to claim 1 having a proximal end and a distal end, wherein said brush head holder further comprises a handle near the proximal end, an actuator element movably arranged on said handle, and a motion transfer element between said actuator element and said connection element near the distal end.

4. The brush according to claim 3, wherein said tubular body slidably houses said connection element, and said motion transfer element extends in the interior of said brush head holder from said handle to said connection element.

5. The brush according to claim 3, wherein said motion transfer element is a rod-shaped extension of said actuator element.

6. The brush according to claim 3, wherein said motion transfer element is a flexible wire.

7. The brush according to claim 1, wherein said tubular body is formed with at least one hole, and said locking means protruding from said hole is moved inwardly when released.

8. The brush according to claim 7, wherein said locking means comprises at least a ball.

9. The brush according to claim 7, wherein said locking means is operatively connected to said connecting element via a tapered element slidably arranged in the tubular body and abutting said locking means.

10. The brush according to claim 9, wherein said tapered element diverges to the distal end of the brush.

11. The brush according to claim 10, wherein the tapered element is slidably arranged on said connection element and loaded by a spring.

12. The brush according to claim 1, configured as a toilet brush.

* * * * *